US011329393B2

(12) United States Patent
Hasegawa et al.

(10) Patent No.: US 11,329,393 B2
(45) Date of Patent: May 10, 2022

(54) ANTENNA DEVICE

(71) Applicant: FUJIKURA LTD., Tokyo (JP)

(72) Inventors: Yuta Hasegawa, Sakura (JP); Ning Guan, Sakura (JP)

(73) Assignee: FUJIKURA LTD., Tokyo (JP)

( * ) Notice: Subject to any disclaimer, the term of this patent is extended or adjusted under 35 U.S.C. 154(b) by 270 days.

(21) Appl. No.: 16/466,467

(22) PCT Filed: Nov. 9, 2017

(86) PCT No.: PCT/JP2017/040471
§ 371 (c)(1),
(2) Date: Jun. 4, 2019

(87) PCT Pub. No.: WO2018/105303
PCT Pub. Date: Jun. 14, 2018

(65) Prior Publication Data

US 2020/0083611 A1 Mar. 12, 2020

(30) Foreign Application Priority Data

Dec. 7, 2016 (JP) ..... JP2016-237789

(51) Int. Cl.
*H01Q 15/02* (2006.01)
*H01Q 21/00* (2006.01)
(Continued)

(52) U.S. Cl.
CPC ..... *H01Q 21/0031* (2013.01); *H01Q 15/02* (2013.01); *H01Q 21/0006* (2013.01); *H01Q 21/06* (2013.01); *H01Q 25/008* (2013.01)

(58) Field of Classification Search
CPC . H01Q 13/206; H01Q 21/065; H01Q 21/0031
See application file for complete search history.

(56) References Cited

U.S. PATENT DOCUMENTS 4,490,723 A * 12/1984 Hardie ..... H01Q 25/008 343/754
4,641,144 A * 2/1987 Prickett ..... H01Q 25/008 343/754

(Continued)

FOREIGN PATENT DOCUMENTS

JP 200 1-44752 A 2/2001
JP 2005-340939 A 12/2005

(Continued)

OTHER PUBLICATIONS

Extended (Supplementary) European Search Report dated May 28, 2020, issued in counterpart EP Application No. 17878832.9. (8 pages).

(Continued)

*Primary Examiner* — Ab Salam Alkassim, Jr.
(74) *Attorney, Agent, or Firm* — WHDA, LLP

(57) ABSTRACT

The present invention provides an antenna device that has a radiation pattern whose peak direction is independent of a frequency of an electromagnetic wave emitted. The antenna device includes: a ground layer (11) made of an electric conductor; a plurality of array antennas (22) provided in a layer above the ground layer (11); and a Rotman lens (32) provided in a layer below the ground layer (11). Each array antenna (22*i*) includes: a power feed line (23Li) at a center of which a feedpoint (23Pi) is located; and a plurality of antenna elements (241*i* through 248*i* and 251*i* through 258*i*) connected to the power feed line (23Li), and has a point symmetric shape with respect to the feedpoint (23Pi) as a center of symmetry. Each feedpoint (23Pi) is coupled to any one output port (322*i*) of the Rotman lens (32) via a slot (111*i*) provided in the ground layer (11).

5 Claims, 8 Drawing Sheets

(51) Int. Cl.
*H01Q 21/06* (2006.01)
*H01Q 25/00* (2006.01)

(56) References Cited

U.S. PATENT DOCUMENTS 5,017,931 A * 5/1991 Carlyon ..... H01Q 21/068 343/700 MS
5,422,649 A * 6/1995 Huang ..... H01Q 21/0075 343/700 MS
5,712,644 A * 1/1998 Kolak ..... G01S 13/931 343/700 MS
6,014,112 A * 1/2000 Koscica ..... H01Q 1/246 343/700 MS
6,094,172 A * 7/2000 Koscica ..... H01Q 13/206 343/700 MS
6,130,653 A * 10/2000 Powers, Jr. ..... H01Q 15/02 343/909
6,424,298 B1 * 7/2002 Nishikawa ..... H01Q 13/206 343/700 MS
6,686,867 B1 * 2/2004 Lissel ..... H01Q 25/002 342/70
7,518,566 B2 * 4/2009 Schoebel ..... H01Q 1/3233 343/754
2002/0126062 A1 * 9/2002 Matthews ..... H01Q 25/008 343/795
2004/0061647 A1 * 4/2004 Roper ..... H01Q 21/0075 343/700 MS
2005/0259028 A1 * 11/2005 Koreyasu ..... H01Q 21/0006 343/853
2008/0100504 A1 * 5/2008 Martin ..... H01Q 15/144 342/179
2008/0297400 A1 * 12/2008 Hansen ..... G01S 13/931 342/70
2010/0265156 A1 * 10/2010 Minami ..... H01Q 13/20 343/893
2011/0241968 A1 * 10/2011 Oota ..... H01Q 21/064 343/853
2011/0285598 A1 * 11/2011 Oota ..... H01Q 15/02 343/833
2012/0092224 A1 * 4/2012 Sauleau ..... H01Q 13/22 343/771
2012/0146842 A1 * 6/2012 Kang ..... H01Q 25/008 342/175
2013/0027240 A1 * 1/2013 Chowdhury ..... G01S 13/931 342/94
2015/0253419 A1 * 9/2015 Alland ..... G01S 13/4463 342/385
2015/0255870 A1 * 9/2015 Okunaga ..... H01Q 21/065 343/700 MS
2016/0248159 A1 * 8/2016 Shiozaki ..... H01Q 7/00

FOREIGN PATENT DOCUMENTS

JP 2011-239258 A 11/2011
JP 2014-195327 A 10/2014

OTHER PUBLICATIONS

Notification of Transmittal of Translation of the International Preliminary Reporton Patentability (Forms PCT/IB/338) issued in counterpart International Application No. PCT/JP2017/040471 dated Jun. 20, 2019 with Forms PCT/IB/373 and PCT/ISA/237 (6 pages).
International Search Report dated Jan. 16, 2018, issued in counterpart application No. PCT/JP2017/040471 (2 pages).
Tekkouk et al., "Multibeam SIW Slotted Waveguide Antenna System Fed by a Compact Dual-Layer Rotman Lens", IEEE Transactions on Antennas and Propagation, Feb. 2016, vol. 64, No. 2, IEEE, pp. 504-514, cited in ISR (11 pages).
Lee et al., "Compact Two-Layer Rotman Lens-Fed Microstrip Antenna Array at 24 GHz", IEEE Transactions on Antennas and Propagation, Feb. 2011, vol. 59, No. 2, pp. 460-466, cited in the specification (7 pages).
Hansen, "Design Trades for Rotman Lenses", IEEE Transactions on Antennas and Propagation, Apr. 1991, vol. 39, No. 4, pp. 464-472, cited in the specification (9 pages).

* cited by examiner

ANTENNA DEVICE

TECHNICAL FIELD

The present invention relates to a technology for performing high-speed transmission wireless communications.

BACKGROUND ART

In recent years, in order to increase communication capacities, attention has been paid to millimeter wave wireless communications having a wide bandwidth and thus allowing more information to be transmitted. However, a loss of a millimeter wave tends to be significant. Thus, millimeter wave wireless communications require a beam forming technology for narrowing a range of a radiation direction of a millimeter wave so as to cause the millimeter wave to follow a target. Usually, the same number of phase elements as the number of beams are required for each antenna element when beam forming is performed. However, since phase elements are costly, research has also been conducted on a technology that uses a Rotman lens which controls beam directions without using phase elements, as in Non-Patent Literature 1. As described in Non-Patent Literature 1, a Rotman lens consists of (i) a planar pattern and (ii) a curved surface, beam ports, and array ports all provided on the planar pattern, wherein the beam ports are supplied with electricity and the array ports are connected to antenna elements. Changing a beam port to be supplied with electricity among the beam ports of the Rotman lens causes a change in the amount of time delay between the array ports. Thus, the Rotman lens allows causing a radiation direction of a beam to be changed over a wide band.

CITATION LIST

Patent Literature

[Patent Literature 1]
Japanese Patent Application Publication, Tokukai, No. 2001-44752 A (Publication Date: Feb. 16, 2001)
[Patent Literature 2]
Japanese Patent Application Publication, Tokukai, No. 2014-195327 A (Publication Date: Oct. 9, 2014)
[Patent Literature 3]
Japanese Patent Application Publication, Tokukai, No. 2005-340939 A (Publication Date: Dec. 8, 2005)

Non-Patent Literature

[Non-patent Literature 1]
R. C. Hansen, 'Design Trades for Rotman Lenses', IEEE TRANSACTIONS ON ANTENNAS AND PROPAGATION, VOL. 39, NO. 4, April 1991
[Non-patent Literature 2]
Woosung Lee, et al, 'CompactTwo-Layer Rotman Lens-Fed Microstrip Antenna Array at 24 GHz', IEEETRANSACTIONS ON ANTENNAS AND PROPAGATION, VOL. 59, NO. 2, February 2011

SUMMARY OF INVENTION

Technical Problem

In a case where a series feed array antenna having a feedpoint located at one end of a power feed line is connected to a Rotman lens as in Non-Patent Literature 2, a peak direction of a radiation pattern changes disadvantageously depending on a frequency of an electromagnetic wave emitted from the series feed array antenna.

The present invention is made in view of the above problem. It is an object of the present invention to provide an antenna device that includes a Rotman lens and has a radiation pattern whose peak direction is independent of a frequency of an electromagnetic wave emitted.

Solution to Problem

In order to attain the object, an antenna device in accordance with an aspect of the present invention is an antenna device including: a ground layer made of an electric conductor; a plurality of array antennas provided in a layer above the ground layer so as to be spaced apart from the ground layer; and a Rotman lens provided in a layer below the ground layer so as to be spaced apart from the ground layer, each of the plurality of array antennas (i) including: a power feed line at a center of which a feedpoint is located; and a plurality of antenna elements connected to the power feed line and (ii) having a point symmetric shape with respect to the feedpoint as a center of symmetry, the feedpoint of each of the plurality of array antennas being coupled to an end of any one of output ports of the Rotman lens via a slot provided in the ground layer.

Advantageous Effects of Invention

According to an antenna device in accordance with an aspect of the present invention, it is possible to provide an antenna device that includes a Rotman lens and has a radiation pattern whose peak direction is independent of a frequency of an electromagnetic wave emitted.

Figure 2:
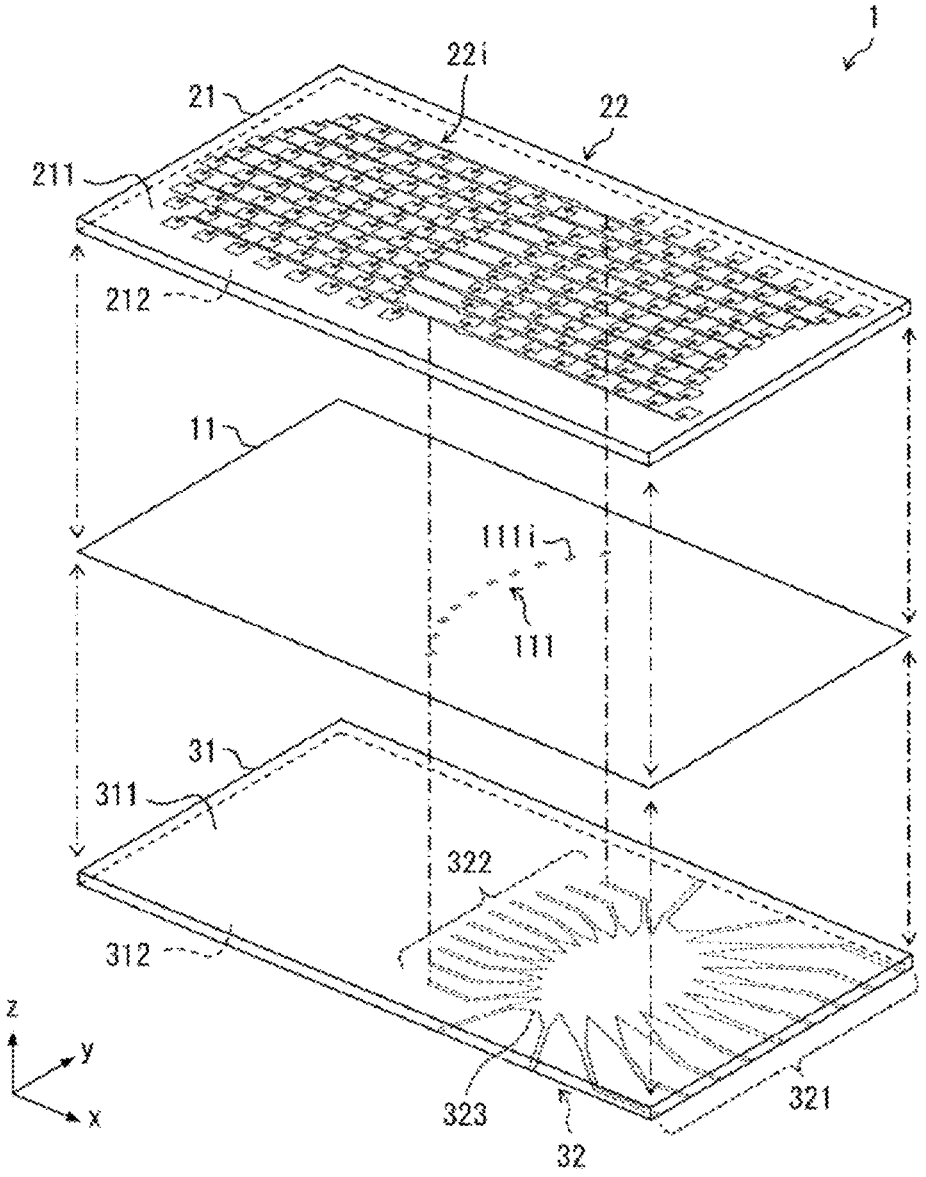
FIG. 2 is an exploded perspective view of a beam forming antenna in accordance with Embodiment 1 of the present invention.
Figure 3:
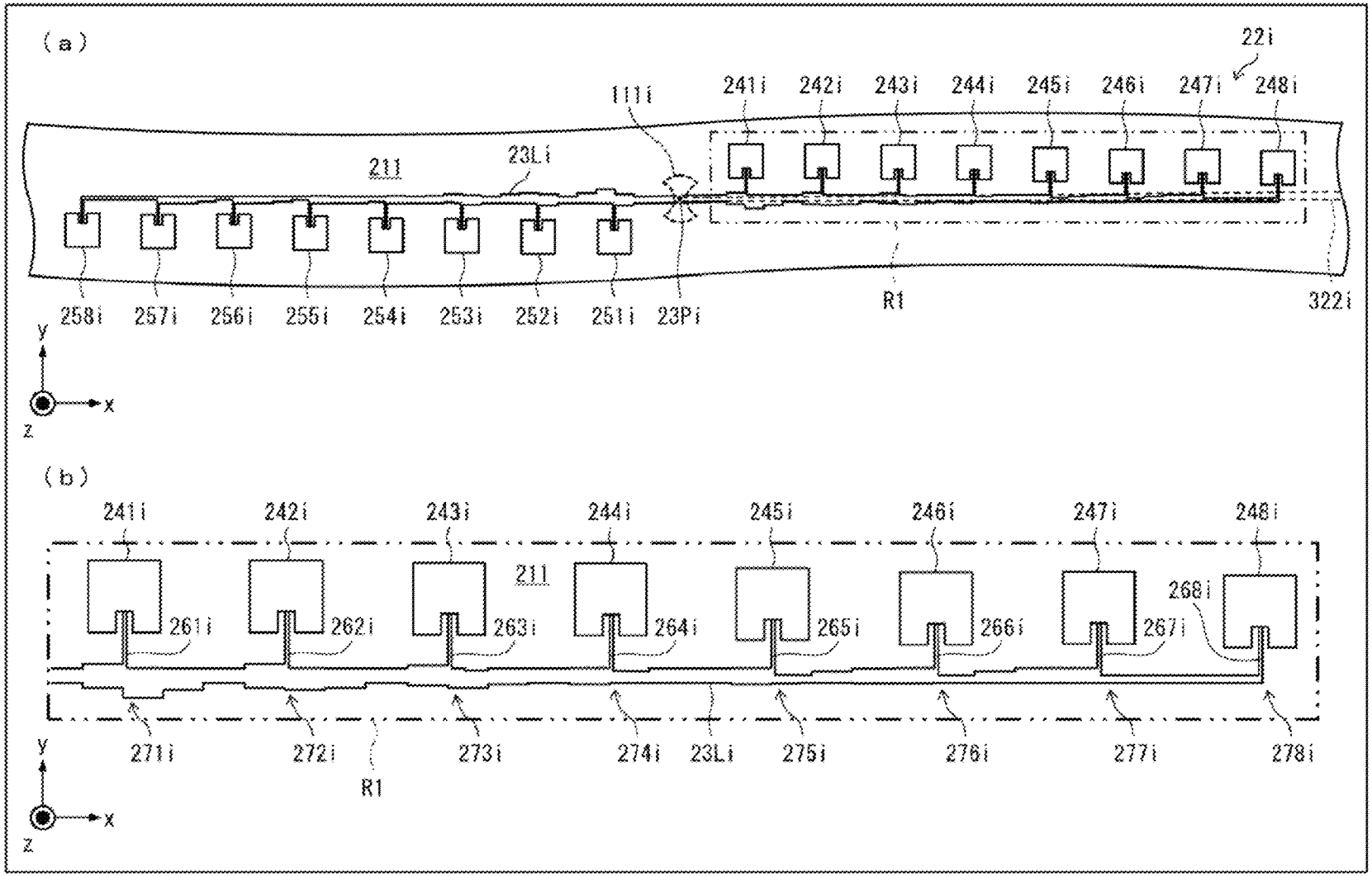

(a) of FIG. 3 is a plan view of an array antenna of the beam forming antenna illustrated in FIG. 2. (b) of FIG. 3 is an enlarged plan view of the array antenna illustrated in (a) of FIG. 3.

Figure 4:
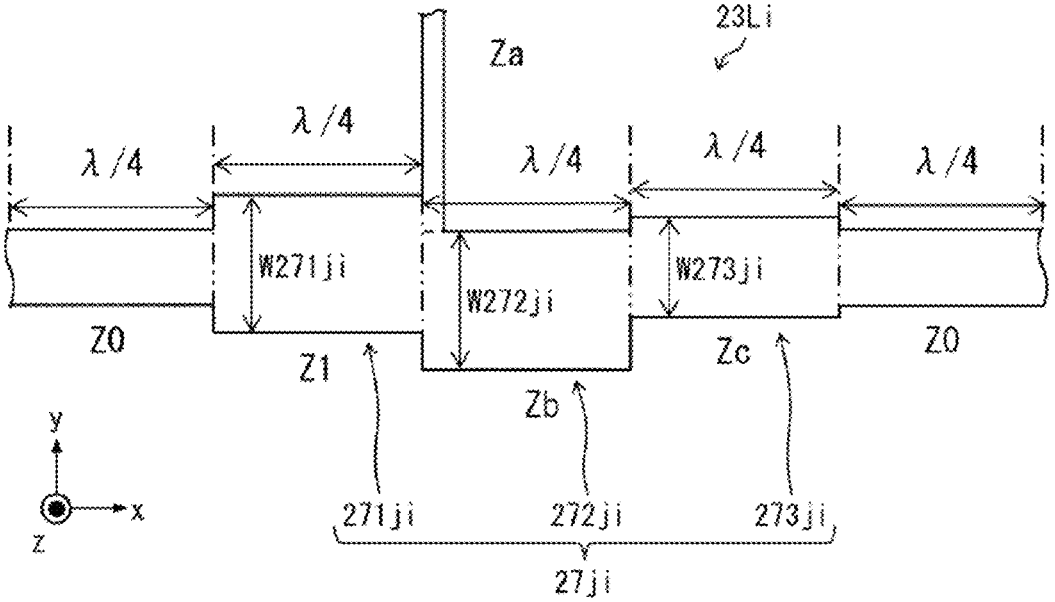

FIG. 4 is a plan view of a branch section of the array antenna illustrated in FIG. 3.

Figure 5:
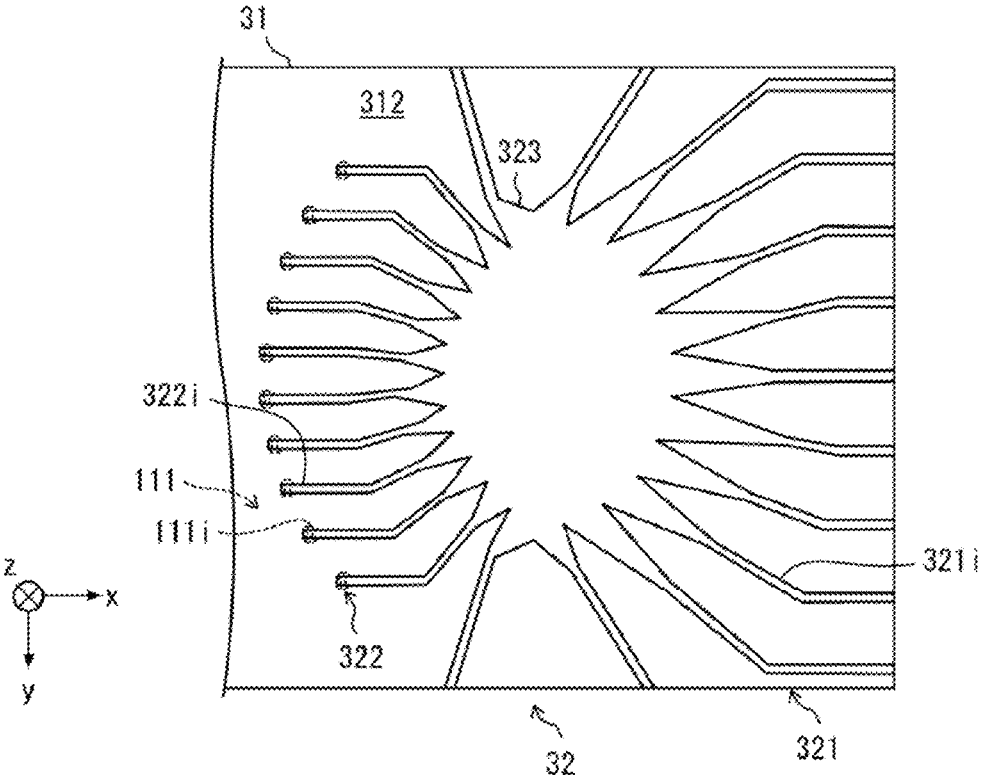

FIG. 5 is a plan view of a Rotman lens of the beam forming antenna illustrated in FIG. 2.

Figure 6:
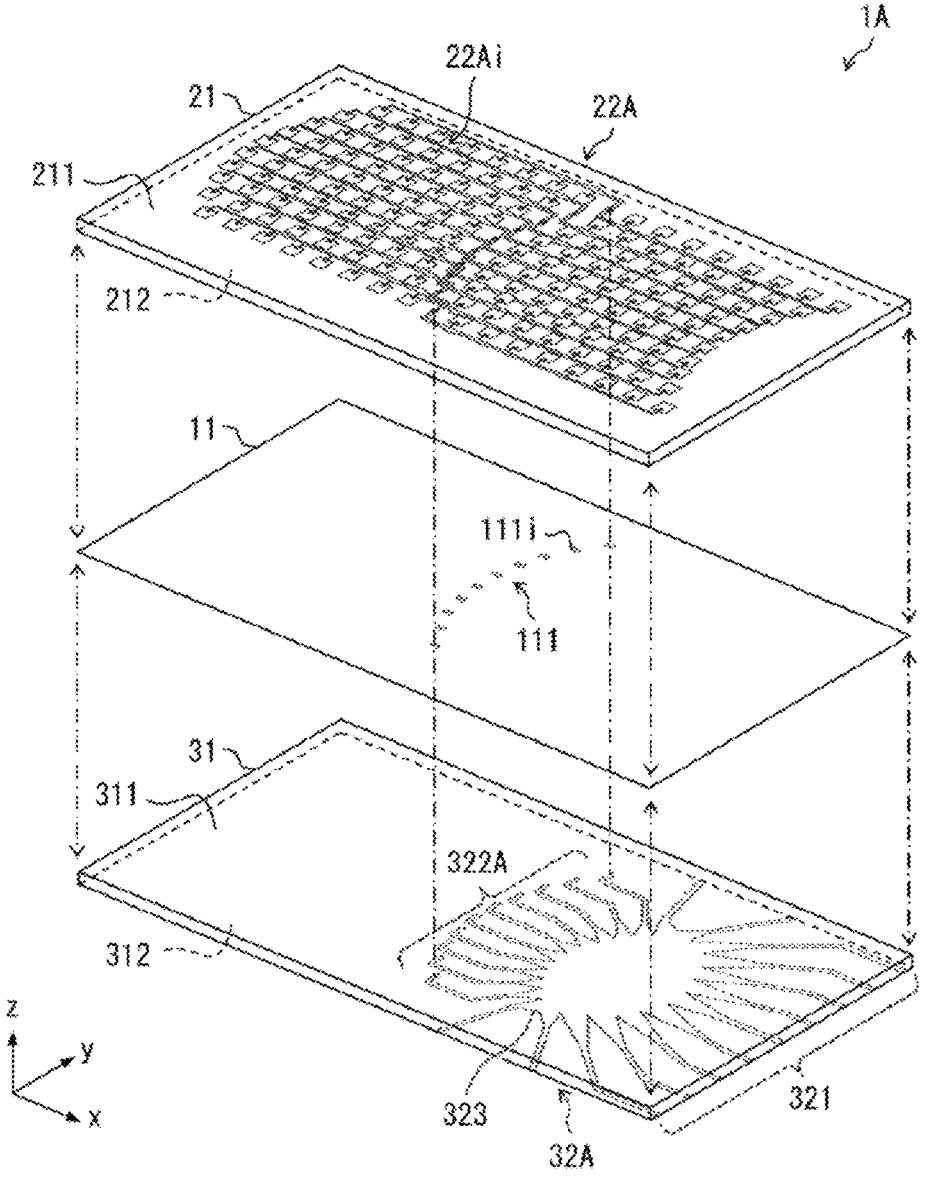

FIG. 6 is an exploded perspective view of a beam forming antenna in accordance with Embodiment 2 of the present invention.

Figure 7:
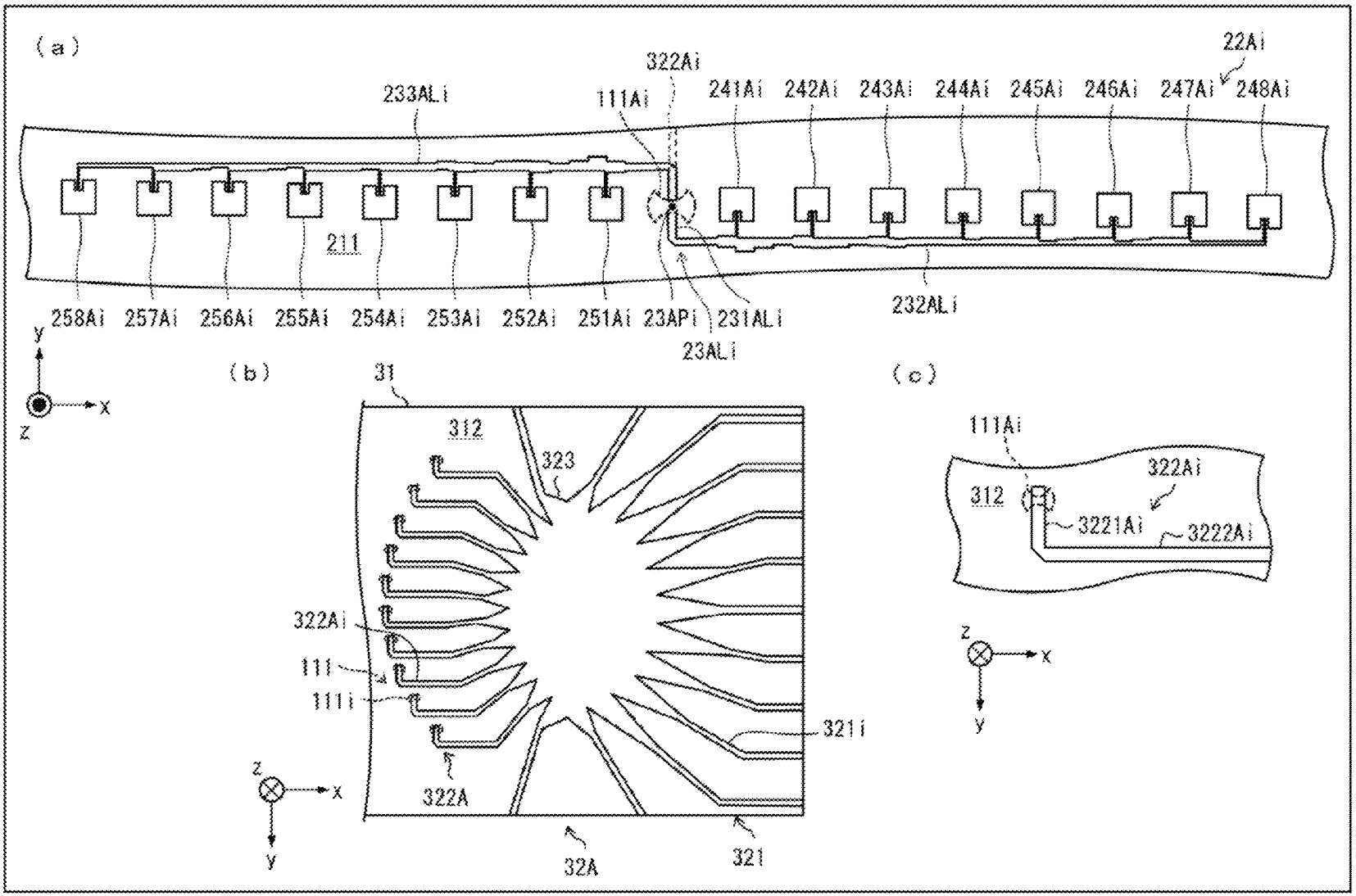

(a) of FIG. 7 is a plan view of an array antenna of the beam forming antenna illustrated in FIG. 6. (b) of FIG. 7 is a plan view of a Rotman lens of the beam forming antenna illustrated in FIG. 6. (c) of FIG. 7 is an enlarged view of one of output ports of the Rotman lens illustrated in (b) of FIG. 7.

Figure 8:
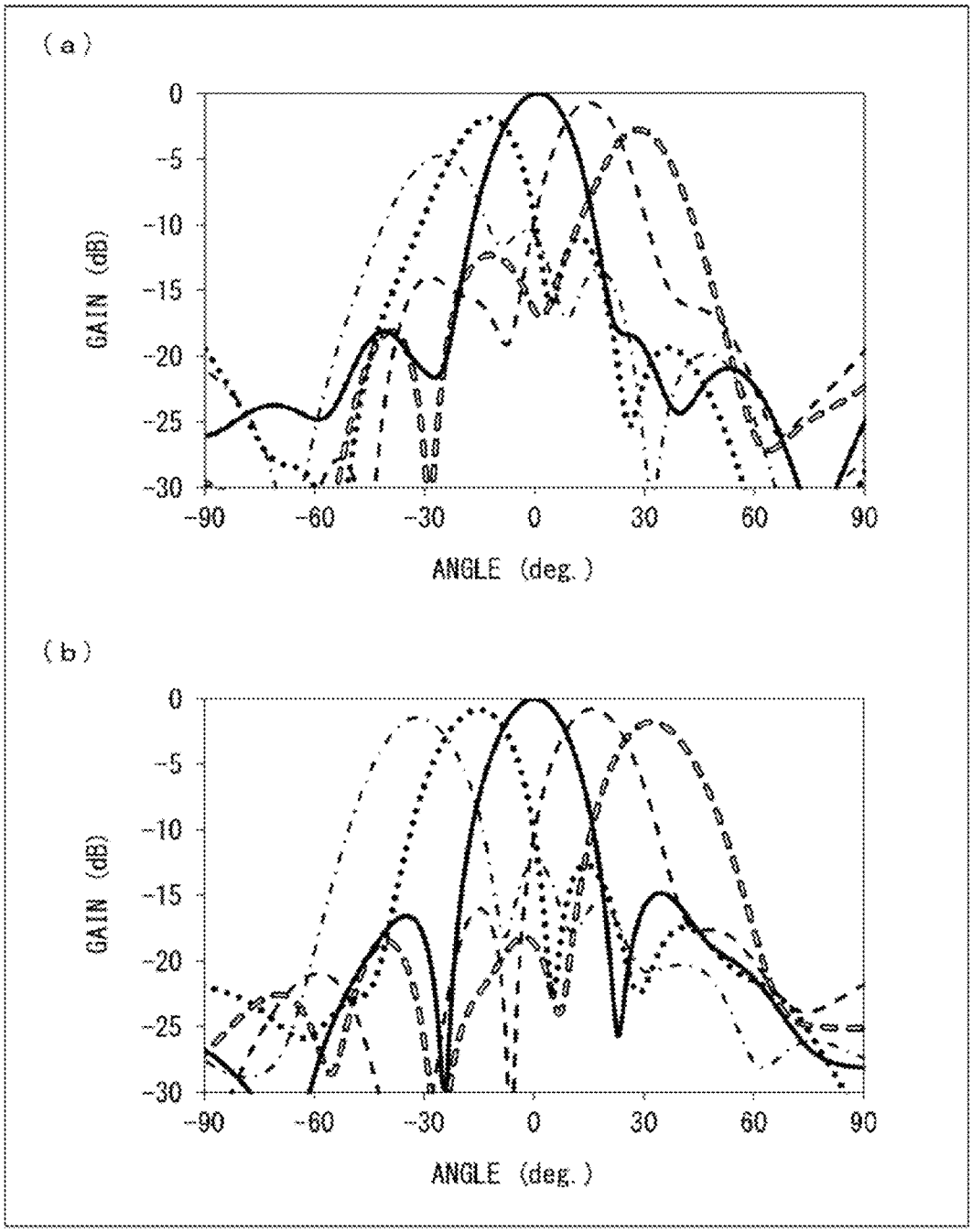

(a) of FIG. 8 illustrates an azimuth-dependency of a gain obtained with use of a beam forming antenna in accordance with an Example of the present invention. (b) of FIG. 8 illustrates an azimuth-dependency of a gain obtained with use of a beam forming antenna in accordance with another Example.

Figure 9:
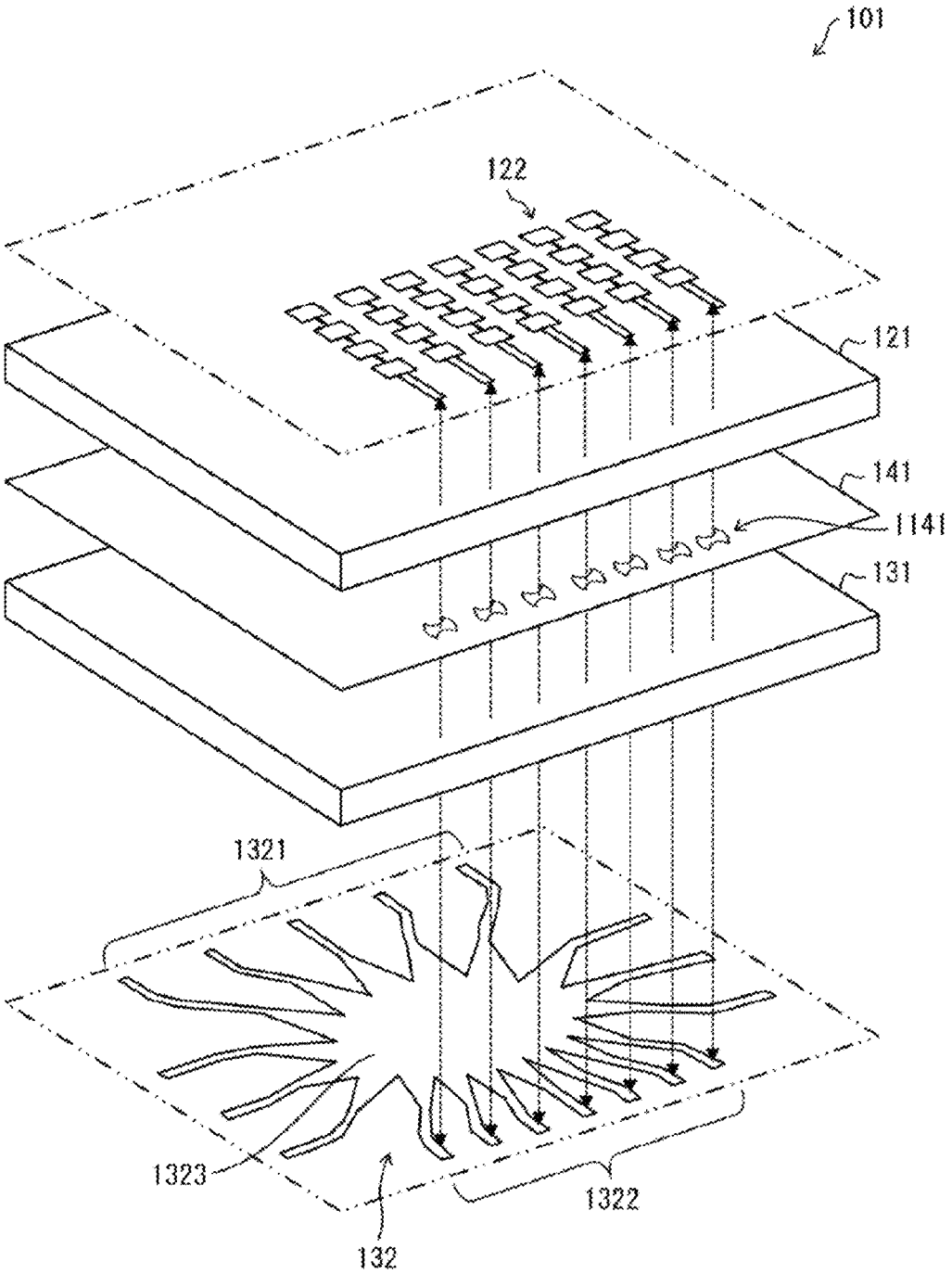

FIG. 9 is an exploded perspective view of a conventional beam forming antenna.

DESCRIPTION OF EMBODIMENTS

[Overview of Beam Forming Antenna]

Figure 1:
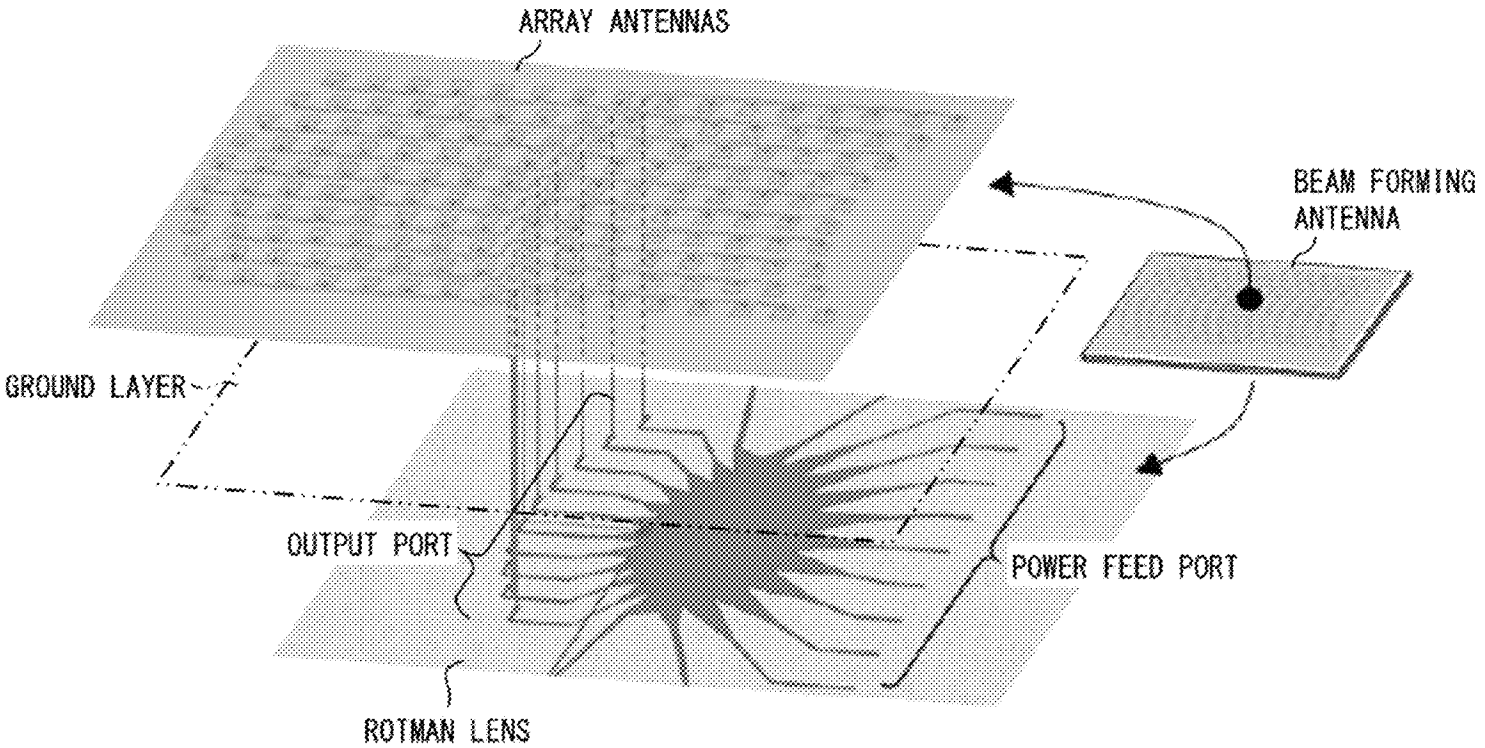
FIG. 1 is an exploded perspective view of a beam forming antenna in accordance with an embodiment of the present invention.

The following description will discuss, with reference to FIG. 1, an overview of a beam forming antenna (corresponding to an antenna device recited in the claims) in accordance with an embodiment of the present invention.

As illustrated in FIG. 1, the beam forming antenna in accordance with the embodiment of the present invention includes a ground layer, a plurality of array antennas, and a Rotman lens.

The ground layer is constituted by a film or plate made of an electric conductor. The plurality of array antennas are provided in a layer above the ground layer so as to be spaced apart from the ground layer. The Rotman lens is provided in a layer below the ground layer so as to be spaced apart from the ground layer. In FIG. 1, the ground layer is indicated using imaginary lines (two-dot chain lines) for ease of viewing the perspective view. For the same reason, a plurality of slots provided with the ground layer are omitted in FIG. 1. Details of the plurality of slots will be described later with reference to FIG. 2 and (a) of FIG. 3, and FIG. 6 and (a) of FIG. 7. Each of the plurality of slots is provided in a region in which an end of an output port of the Rotman lens and a feedpoint of an array antenna overlap with each other when the beam forming antenna is viewed in plan.

Each of the plurality of array antennas includes (i) a power feed line at a center of which a feedpoint is located and (ii) a plurality of antenna elements connected to the power feed line. The plurality of array antennas has a point symmetric shape with respect to the feedpoint as a center of symmetry (see (a) of FIG. 3 and (a) of FIG. 7).

The feedpoint of each of the plurality of array antennas is coupled to an end of any one of the output ports of the Rotman lens via a slot provided in the ground layer (see FIG. 2, (a) of FIG. 3, FIG. 6, and (a) of FIG. 7).

Note that the beam forming antenna as described above can be realized, for example, using a dielectric substrate constituted by a ground layer and two dielectric layers (a first dielectric layer and a second dielectric layer) that sandwich the ground layer therebetween. In this instance, the plurality of array antennas may be formed on a front surface of the dielectric substrate and the Rotman lens may be formed on a back surface of the dielectric substrate.

According to this configuration, the plurality of array antennas and the Rotman lens can be formed on the same substrate. This makes it possible to reduce a cost of producing the beam forming antenna.

Embodiment 1

The following description will discuss, with reference to FIGS. 2 to 5, a beam forming antenna in accordance with Embodiment 1 of the present invention. FIG. 2 is an exploded perspective view of a beam forming antenna 1 in accordance with Embodiment 1. (a) of FIG. 3 is a plan view of an array antenna 22*i* which is one of a plurality of array antennas 22 of the beam forming antenna 1. (b) of FIG. 3 is an enlarged plan view of the array antenna 22*i* illustrated in (a) of FIG. 3, and is an enlarged plan view of a region R1 illustrated in (a) of FIG. 3. FIG. 4 is a plan view of a branch portion of the array antenna 22*i* illustrated in FIG. 3. FIG. 5 is a plan view of a Rotman lens 32 of the beam forming antenna 1. Further, an exploded perspective view of the series feed array antenna (hereafter, a conventional beam forming antenna 101) described in Non-Patent Literature 2 is illustrated in FIG. 9.

As illustrated in FIG. 9, the conventional beam forming antenna 101 includes a ground layer 141, a dielectric layer 121, a plurality of array antennas 122, a dielectric layer 131, and a Rotman lens 132. The Rotman lens 132 includes a plurality of power feed ports 1321, a plurality of output ports 1322, and a main body 1323. The ground layer 141 is provided with a plurality of slots 1141. One end (an end on a side opposite to the main body 1323) of each of the plurality of output ports 1322 of the Rotman lens 132 is coupled to a feedpoint, which is one end of a corresponding one of the plurality of array antennas 122, via a corresponding one of the plurality of slots 1141. Note that two-dot chain lines in FIG. 9 virtually indicate a plane in which the plurality of array antennas 122 are provided and a plane in which the Rotman lens 132 is provided. In FIG. 9, the plurality of array antennas 122 and one main surface of the dielectric layer 121 are spaced apart from each other. In reality, however, the plurality of array antennas 122 are provided on the one main surface of the dielectric layer 121. The same is true of the Rotman lens 132.

On the other hand, the beam forming antenna 1, which is an aspect of an antenna device recited in the claims, includes a ground layer 11, a dielectric layer 21, the plurality of array antennas 22, a dielectric layer 31, and the Rotman lens 32, as illustrated in FIG. 2.

In a coordinate system illustrated in FIG. 2, a direction along a normal line of a main surface 211 of the dielectric layer 21 is defined as a z-axis direction, a direction in which a power feed line 23Li (see FIG. 3) of each array antenna 22*i* to be described later extends is defined as an x-axis direction, and a y-axis direction is defined such that the y-axis direction, together with the x-axis direction and the z-axis direction, constitutes a right-handed orthogonal coordinate system. Further, a direction from a main surface 212 toward the main surface 211 along the z-axis direction is defined as a z-axis positive direction, a direction from a plurality of output ports 322 toward a plurality of power feed ports 321 of the Rotman lens 32 (described later) is defined as an x-axis positive direction, and a y-axis positive direction is defined such that the y-axis positive direction, together with the x-axis positive direction and the z-axis positive direction, constitutes a right-handed orthogonal coordinate system.

The ground layer 11 and the dielectric layers 21 and 31, which are a pair of dielectric layers sandwiching the ground layer 11 therebetween, constitute a dielectric substrate. The main surface 211, which is one main surface (a main surface on a z-axis positive direction side) of the dielectric layer 21, constitutes a front surface of the dielectric substrate. The main surface 212, which is the other main surface (a main surface on a z-axis negative direction side) of the dielectric layer 21, is in contact with the ground layer 11. A main surface 311, which is one main surface (a main surface on the z-axis positive direction side) of the dielectric layer 31, is in contact with the ground layer 11. A main surface 312, which is the other main surface (a main surface on the z-axis negative direction side) of the dielectric layer 31, constitutes a back surface of the dielectric substrate.

(Plurality of Array Antennas 22)

The plurality of array antennas 22 are a conductor pattern obtained by patterning a conductor film (in Embodiment 1, a copper thin film) provided on the main surface 211. In Embodiment 1, the plurality of array antennas 22 are constituted by ten array antennas 22*i*, each of which has a shape as illustrated in (a) and (b) of FIG. 3.

Each array antenna 22*i* includes (i) the power feed line 23Li, (ii) 16 antenna elements 241*i* through 248*i* and 251*i* through 258*i* connected to the power feed line 23Li, (iii) sub power feed lines 261*i* through 268*i* connecting the power feed line 23Li to the respective antenna elements 241*i* through 248*i*, and (iv) sub power feed lines connecting the power feed line 23Li to the respective antenna elements 251*i* through 258*i*. The power feed line 23Li is a band-like conductor pattern extending along the x-axis direction. At the center of the power feed line 23Li, a feedpoint 23Pi is located.

In Embodiment 1, a configuration of each array antenna 22*i* will be described based on: a portion of the power feed line 23Li which portion extends from the feedpoint 23Pi in the x-axis positive direction; the sub power feed lines 261*i* through 268*i* connected to this portion; and the antenna elements 241*i* through 248*i*, as illustrated in (b) of FIG. 3. Each array antenna 22*i* has a point symmetric shape with respect to the feedpoint 23Pi as a center of symmetry, as illustrated in (a) of FIG. 3. In the present embodiment, therefore, descriptions will not be given on a portion of the power feed line 23Li which portion extends from the feedpoint 23Pi in the x-axis negative direction, the eight sub power feed lines connected to this portion, and the antenna elements 251*i* through 258*i*.

The portion of the power feed line 23Li which portion extends from the feedpoint 23Pi in the x-axis positive direction includes branch sections 271*i* through 277*i* to which the respective sub power feed lines 261*i* through 267*i* are connected. The branch section 271*i* is a branch section that is located closest to the feedpoint 23Pi, i.e., a branch section that is located most upstream. The branch section 277*i* is a branch section that is located furthest from the feedpoint 23Pi, i.e., a branch section that is located most downstream. Between the branch section 271*i* and the branch section 277*i*, the branch sections 272*i* through 276*i* are arranged at equal intervals from a side closer to the feedpoint 23Pi to a side farther from the feedpoint 23Pi, that is, from upstream to downstream. The sub power feed line 268*i* is connected to a terminal end 278*i*, which is a tip of the portion of the power feed line 23Li which portion extends from the feedpoint 23Pi in the x-axis positive direction. Note that the branch sections 271*i* through 277*i* are generalized by the term "branch section 27*ji*" (j is an integer of $1 \leq j \leq 7$).

Let a center wavelength λ be an effective wavelength, on the power feed line, of a center frequency of an operation band of the beam forming antenna 1. Each branch section 27*ji* is constituted by unit sections 271*ji*, 272*ji*, and 273*ji* which are continuously provided and each of which has a length of λ/4 along the x-axis direction. The unit sections 271*ji*, 272*ji*, and 273*ji* are continuously provided from upstream to downstream along the power feed line 23Li, and respectively correspond to a first section, a second section, and a third section recited in the claims. Hereinafter, the unit sections 271*ji*, 272*ji*, and 273*ji* may be referred to as a first section 271*ji*, a second section 272*ji*, and a third section 273*ji*, respectively. The first to third sections 271*ji*, 272*ji*, and 273*ji* have respective widths W271*ji*, W272*ji*, and W273*ji* that are determined so that characteristic impedances Z1, Zb, and Zc of the respective first to third sections 271*ji*, 272*ji*, and 273*ji* are such that the characteristic impedances of each adjacent ones of the first to third sections 271*ji*, 272*ji*, and 273*ji* match each other.

According to this configuration, it is possible to reduce a return loss that may be caused by connecting the antenna elements 241*i* through 247*i* to the power feed line 23Li. Accordingly, an increase in gain of the beam forming antenna 1 is achieved.

Further, each of the antenna elements 241*i* through 247*i* is connected to the vicinity of a boundary between the first section 271*ji* and the second section 272*ji* via a corresponding one of the sub power feed lines 261*i* through 267*i*. Each of the sub power feed lines 261*i* through 267*i* extends from the vicinity of the boundary of the first section 271*ji* and the second section 272*ji* in the y-axis positive direction. Note that the sub power feed line 268*i* has the same configuration as that of each of the sub power feed lines 261*i* through 267*i*.

In the power feed line 23Li, an electric current supplied to the feedpoint 23Pi passes through each of the branch sections 271*i* through 277*i* sequentially during the course of flowing from the feedpoint 23Pi to the terminal end 278*i*. When the electric current passes through each of the branch sections 271*i* through 277*i*, for example, the branch section 271*i*, the electric current flowing through the power feed line 23Li is divided into (i) an electric current that continues to flow through the power feed line 23Li toward the branch section 272*i*, which is the next branch section and (ii) an electric current that flows through the sub power feed line 261*i* toward the antenna element 241*i*. Let a first electric current be the electric current that flows through the power feed line 23Li toward the branch section 272*i* and let a second electric current be the electric current that flows through the sub power feed line 261*i* toward the antenna element 241*i*. A branching ratio at the branch section 271*i*, i.e., a ratio of electric power supplied to the antenna element 241*i* to electric power supplied to the branch section 272*i*, is given by a ratio of the second electric current to the first electric current. The same applies to a branching ratio in each of the other branch sections 272*i* through 277*i*.

Note here that the width W272*ji* is a width with which the branching ratio at the branch section 27*ji* has a predetermined value. The width W271*ji* is a width with which a combined impedance between the second section 272*ji* and the antenna element branched from the branch section 27*ji* matches a characteristic impedance upstream of the branch section 27*ji*. The width W273*ji* of the third section 273*ji* is a width with which a characteristic impedance of the second section 272*ji* matches a characteristic impedance downstream of the branch section 27*ji*.

According to this configuration, it is possible to reliably reduce a return loss that may be caused by connecting the antenna elements to the power feed line. Accordingly, an increase in gain of the antenna device is reliably achieved.

Further, the branching ratio at each branch section 27*ji* is determined so as to be lower as the branch section 27*ji* is provided more upstream along the power feed line 23Li and to be higher as the branch section 27*ji* is provided more downstream along the power feed line 23Li. That is, the branching ratio of each branch section 27*ji* is determined so that the branching ratio of the branch section 271*i* is the lowest, the branching ratios of the branch sections 272*i* through 276*i* increase in this order, and the branching ratio of the branch section 277*i* is the highest.

According to this configuration, powers of beams emitted from the respective antenna elements 241*i* through 248*i* can be easily controlled. This allows a radiant efficiency and a side lobe ratio of the beam forming antenna 1 to be easily controlled. In other words, the designing of the beam forming antenna 1 having a desired radiant efficiency and side lobe ratio is facilitated.

Further, the antenna elements 241*i* through 248*i* and 251*i* through 258*i* of the array antenna 22*i* are congruent. According to this configuration, congruency of the plurality of antenna elements facilitates designing of the beam forming antenna 1.

(Rotman Lens 32)

The Rotman lens 32 is a conductor pattern obtained by patterning a conductor film (in Embodiment 1, a copper thin film) provided on the main surface 312. As illustrated in FIG. 5, the Rotman lens 32 includes the plurality of power feed ports 321, the plurality of output ports 322, and a main body 323. In Embodiment 1, the plurality of power feed ports 321 are constituted by nine power feed ports 321*i*, and the plurality of output ports 3222 are constituted by ten output ports 322*i*.

An end section including an end (a terminal end of each output port 322*i*) of each output port 322*i* which end is on a side opposite to the main body 323 extends along the x-axis.

When the Rotman lens 32 is viewed in plan as illustrated in FIG. 5, a slot 111*i* is provided in the ground layer 11 at a position corresponding to the vicinity of the terminal end of each output port 322*i*. That is, the ground layer 11 is provided with a plurality of slots 111.

(Coupling of Plurality of Array Antennas 22 and Rotman Lens 32)

The plurality of array antennas 22 are arranged on the main surface 211 so that when each array antenna 22*i* is viewed in plan as illustrated in (a) of FIG. 3, the feedpoint 23Pi overlaps with the terminal end of an output port 322*i* of the Rotman lens 32 and with a slot 111*i* of the ground layer 11. Accordingly, the feedpoint 23Pi of each of the plurality of array antennas 22 is coupled to the terminal end of any one output port 322*i* of the Rotman lens 32 via a slot 111*i*. As such, electric power that has reached the terminal end of each output port 322*i* via the main body 323 after being supplied to any one power feed port 321*i* of the Rotman lens 32 is coupled to the feedpoint 23Pi of a corresponding array antenna 22*i* via a slot 111*i* and radiated from the antenna elements 241*i* through 248*i* and 251*i* through 258*i* of the array antenna 22*i*.

(Function of Beam Forming Antenna 1)

When an angle between a peak direction of a radiation pattern of the conventional beam forming antenna and a zenith direction is defined as θ, $$\sin\theta = f_0\Delta f/(f_0+\Delta f) \quad \text{[Math 1]}$$

where the zenith direction is 0°, $f_0$ is a frequency at which the conventional beam forming antenna faces the zenith direction, and Δf is a frequency shift from $f_0$.

However, in a case where the feedpoint 23Pi is arranged at the center (in Embodiment 1, a midpoint) of the power feed line 23Li as illustrated in (a) of FIG. 3, beams having peak shifts in opposite directions are superimposed on each other, and a change in a peak is less likely to occur, accordingly. This is utilized by the beam forming antenna 1, which is an aspect of the present invention.

A radiant efficiency and a side lobe ratio of an array antenna depend on a power feed intensity ratio of each antenna element. As such, a size of an antenna element itself may be changed in order to adjust a power feed ratio as in Patent Literature 1. However, this makes it difficult to match antenna elements with each other and to adjust a power feed ratio of each antenna element. The beam forming antenna 1 in accordance with an embodiment of the present invention has the following configurations: (1) as illustrated in (b) of FIG. 3, a configuration of the branch section 27*ji* at which electric power is branched from the power feed line 23Li to each of the antenna elements 241*i* through 247*i* is identical among all the antenna elements 241*i* through 247*i*, and the antenna elements 241*i* through 247*i* are identical in size; and (2) a width of the power feed line 23Li is changed for each unit section (each of the first to third sections 271*ji*, 272*ji*, and 273*ji*). The configurations (1) and (2) allow adjusting a ratio of electric power distributed to each of the antenna elements 241*i* through 248*i*. By controlling the radiation pattern using these configurations, it is possible to simplify the designing of the beam forming antenna 1.

As illustrated in FIG. 4, the branching ratio from the feed line 23Li to each of the antenna elements 241*i* through 247*i* is determined by a ratio between characteristic impedances Za and Zb. A combined impedance Zab is expressed by Zab=Za·Zb/(Za+Zb). To achieve matching, Z1 is expressed by the following equation:

$$Z1=\sqrt{Zab\cdot Z0} \quad \text{[Math 2]}$$

Likewise, *Zc* is expressed by the following equation:

$$Zc=\sqrt{Zb\cdot Z0} \quad \text{[Math 3]}$$

By determining Z0, which is a characteristic impedance of the power feed line 23Li, a branching ratio, and Za as initial values, it is possible to determine the widths W271*ji*, W272*ji*, and W273*ji* of the first to third sections 271*ji*, 272*ji*, and 273*ji* constituting the branch section 27*ji* included in the power feed line 23Li illustrated in FIG. 4. Accordingly, a desired branching ratio can be easily obtained. Thus, the beam forming antenna 1 can be designed so as to achieve impedance-matching. Consequently, the beam forming antenna 1, which is impedance-matched, enables reducing a return loss that may be caused at the branch section 27*ji*.

Embodiment 2

The following description will discuss, with reference to FIGS. 6 and 7, a beam forming antenna in accordance with Embodiment 2 of the present invention. FIG. 6 is an exploded perspective view of a beam forming antenna 1A in accordance with Embodiment 2. (a) of FIG. 7 is a plan view of an array antenna 22Ai, which is one of a plurality of array antennas 22A of the beam forming antenna 1A. (b) of FIG. 7 is a plan view of a Rotman lens 32A of the beam forming antenna 1A. (c) of FIG. 7 is an enlarged view of an output port 322Ai, which is one of output ports 322A of the Rotman lens 32A. For convenience of explanation, members having the same functions as those of the members explained in Embodiment 1 are denoted by the same reference numerals, and the explanation thereof will not be repeated.

In a case where the Rotman lens 32 is used to set radiation directions of the respective plurality of array antennas 22, it is preferable that antenna elements 241*i* through 248*i* and 251*i* through 258*i* have low angular dependency on the directions set. As such, in one embodiment of the present invention, it is preferable that antenna elements are as aligned as possible on a straight line, as described in Patent Literatures 2 and 3. The beam forming antenna 1A is obtained on the basis of the configuration of the beam forming antenna 1 in accordance with Embodiment 1 and by changing the arrangement of the antenna elements 241Ai through 248Ai and 251Ai through 258Ai so that the antenna elements 241Ai through 248Ai and the antenna element 251Ai through 258Ai are arranged on a straight line along the x-axis. That is, the array antenna 22Ai (see (a) of FIG. 7) of the beam forming antenna 1A are configured such that the plurality of antenna elements 241Ai through 248Ai and 251Ai through 258Ai are provided on a straight line.

Note that the plurality of array antennas 22A and the Rotman lens 32A of the beam forming antenna 1A are members provided in place of the plurality of array antennas 22 and the Rotman lens 32, respectively, of the beam forming antenna 1.

In a case where electric power is centrally supplied to a feedpoint 23APi located at a center of a power feed line 23ALi via a slot 111*i*, which is one of a plurality of slots 111 provided in a ground layer 11, an electric current that is supplied in a direction from the feedpoint 23APi toward the antenna elements 241Ai through 248Ai and an electric current that is supplied in a direction from the feedpoint 23APi toward the antenna elements 251Ai through 258Ai are opposite in phase. As such, supply of electric power to the patch antenna (antenna elements) needs to be carried out such that electric power is supplied to the antenna elements 241Ai through 248Ai from a direction opposite to a direction from which electric power is supplied to the antenna elements 251Ai through 258Ai.

In order to arrange the antenna elements on the same straight line while allowing electric power to be supplied from opposite directions, the beam forming antenna 1A is configured such that the antenna elements 241Ai through 248Ai and 251Ai through 258Ai are provided as illustrated in (a) of FIG. 7 and the Rotman lens 32A is provided as illustrated in (b) of FIG. 7. Specifically, (1) the array antenna 22Ai is designed such that the vicinity of the feedpoint 23APi is bent into a crank-like shape so that the antenna elements 241Ai through 248Ai and the antenna elements 251Ai through 258Ai are on the same straight line and (2) the output port 322Ai, which is each of the plurality of output ports 322A of the Rotman lens 32A, is designed so that an end section including a distal end of each output port 322A of the Rotman lens 32A extends along a direction (y-axis direction) in which a portion of the power feed line 23ALi which portion is in the vicinity of the feedpoint 23APi of the array antenna 22Ai extends.

More specifically, as illustrated in (a) of FIG. 7, the power feed line 23ALi is constituted by a power feed section 231ALi, a first radiation section 232ALi, and a second radiation section 233ALi. The power feed section 231ALi is located in a center part of the power feed line 23ALi and includes a feed part 23APi. The power feed section 231ALi extends along the y-axis direction, which is a first direction recited in the claims (in Embodiment 2, in parallel). The first radiation section 232ALi extends along the x-axis positive direction (in Embodiment 2, in parallel) from one end (an end of the power feed section 231ALi on a y-axis negative direction side) of the power feed section 231ALi. The x-axis positive direction corresponds to one of two directions along a second direction recited in the claims. Of course, the y-axis direction, which is the first direction, and the x-axis direction, which is the second direction, intersect with each other (in Embodiment 2, perpendicularly). The second radiation section 233ALi extends along the x-axis negative direction (in Embodiment 2, in parallel) from the other end (an end of the power feed section 231ALi on a y-axis positive direction side) of the power feed section 231ALi. The x-axis negative direction corresponds to the other of the two directions along the second direction recited in the claims.

Each of the antenna elements 241Ai through 248Ai is provided on a y-axis positive direction side of the first radiation section 232ALi, as illustrated in (a) of FIG. 7. A configuration of a portion where the antenna elements 241Ai through 248Ai are connected to the first radiation section 232ALi is the same as the configuration of the portion (region R1) where the antenna elements 241*i* through 248*i* are connected to the power feed line 23Li of the beam forming antenna 1 in accordance with Embodiment 1 (see (b) of FIG. 3). Each of the antenna elements 251Ai through 258Ai is provided on a y-axis negative direction side of the second radiation section 233ALi, as illustrated in (a) of FIG. 7. A configuration of a portion where the antenna elements 251Ai through 258Ai are connected to the second radiation section 233ALi is the same as the configuration of the portion where the antenna elements 251*i* through 258*i* are connected to the power feed line 23Li of the beam forming antenna 1 in accordance with Embodiment 1. (1) A length between a center axis of the first radiation section 232ALi and a center of each of the antenna elements 241Ai through 248Ai and (2) a length between a center axis of the second radiation section 233ALi and a center of each of the antenna elements 251Ai through 258Ai are equal. Further, in the power feed section 231ALi, a length from the feed part 23APi to the one end (the end on the y-axis negative direction side) of the power feed section 231ALi is equal to a length from the feed part 23APi to the other end (the end on the y-axis positive direction side) of the power feed section 231ALi. Accordingly, the antenna elements 241Ai through 248Ai and 251Ai through 258Ai are provided on a straight line that extends along the x-axis (in Embodiment 2, in parallel) and passes through the feed part 23APi.

As illustrated in (c) of FIG. 7, the output port 322Ai, which is each of the plurality of output ports 322A of the Rotman lens 32A, includes an end section 3221Ai and a center section 3222Ai, which is a section continuous with the end section 3221Ai. The end section 3221Ai includes an end of each output port 322Ai and extends along the y-axis direction. The center section 3222Ai extends in the x-axis direction. That is, in Embodiment 2, the end section 3221Ai and the center section 3222Ai are perpendicular to each other.

According to this configuration, since the plurality of antenna elements 241Ai through 248Ai and 251Ai through 258Ai are provided on the same straight line, it is possible to perform beam scanning over a wide band and at a wide angle. Note that the center section 3222Ai of each output port 322Ai only needs to extend along the x-axis direction, i.e., the second direction, and is not limited to a particular shape. For example, a shape of the center section 3222Ai may be a straight line or a serpentine curve.

Note that an end of the output port 322Ai (an end of the end section 3221Ai on a side opposite to an end of the end section 3221Ai which end is continuous with the center section 3222Ai) is coupled to the feedpoint 23APi of the antenna array 22Ai, which is any one of the antenna arrays constituting the plurality of antenna arrays 22A, via the slot 111*i* which is any one of the slots constituting the plurality of slots 111.

EXAMPLES

A beam forming antenna 1 in accordance with Example 1 of the present invention has the array antenna 22*i* illustrated in FIG. 3. A beam forming antenna 1A in accordance with Example 2 of the present invention has the array antenna 22Ai illustrated in (a) of FIG. 7. In Examples 1 and 2, the number of the array antennas 22*i* of the beam forming antenna 1 and the number of the array antennas 22Ai of the beam forming antenna 1A were each 6, the number of the power feed ports 321*i* in each of the Rotman lenses 32 and 32A was 5, the number of the output ports 322*i* of the Rotman lens 32 and the number of the output ports 322Ai of the Rotman lens 32A were each 6, and the number of the slots 111*i* was 6.

An azimuth-dependency (radiation pattern) of a gain obtained by Example 1 is illustrated in (a) of FIG. 8 and an azimuth-dependency (radiation pattern) of a gain obtained by Example 2 is illustrated in (b) of FIG. 8. Referring to (a) and (b) of FIG. 8, Examples 1 and 2 are compared. The comparison reveals that Example 2 has a radiant intensity which is less likely to be reduced than Example 1 when a radiation direction is changed. The five plots shown in (a) of FIG. 8 were obtained by changing the power feed port 321*i* of each of the Rotman lenses 32 and 32A. The same applies to the five plots shown in (b) of FIG. 5.

(Recap)

An antenna device (1, 1A) in accordance with an aspect of the present invention is an antenna device (1, 1A) including: a ground layer (11) made of an electric conductor; a plurality of array antennas (22, 22A) provided in a layer above the ground layer (11) so as to be spaced apart from the ground layer (11); and a Rotman lens (32, 32A) provided in a layer below the ground layer (11) so as to be spaced apart from the ground layer (11), each (22*i*, 22Ai) of the plurality of array antennas (22, 22A) (i) including: a power feed line (23Li, 23ALi) at a center of which a feedpoint (23Pi, 23APi) is located; and a plurality of antenna elements (241*i* through 248*i* and 251*i* through 258*i*, 241Ai through 248Ai and 251Ai through 258Ai) connected to the power feed line (23Li, 23ALi) and (ii) having a point symmetric shape with respect to the feedpoint (23Pi, 23APi) as a center of symmetry, the feedpoint (23Pi, 23APi) of each of the plurality of array antennas (22, 22A) being coupled to an end of any one (322*i*, 322Ai) of output ports of the Rotman lens (32, 32A) via a slot (111) provided in the ground layer (11).

According to the above configuration, electric power is supplied to the array antennas from the center of the power feed line. Accordingly, even in a case where a frequency of an electromagnetic wave to be supplied is changed, it is possible to reduce a change in beam direction resulting from the change in the frequency. Therefore, according to the present antenna device, it is possible to realize an antenna device that has a radiation pattern whose peak direction is independent of an electromagnetic wave emitted.

In an aspect of the present invention, the antenna device (1, 1A) is preferably configured such that in a case where an effective wavelength, on the power feed line, of a center frequency of an operation band of the antenna device (1, 1A) is defined as a center wavelength λ, a branch section (27*ji*), which is a section at which each of the plurality of antenna elements (241*i* through 248*i* and 251*i* through 258*i*, 241Ai through 248Ai and 251Ai through 258Ai) is connected to the power feed line (23Li, 23ALi), is constituted by a plurality of unit sections (271*ji*, 272*ji*, and 273*ji*) which are continuously provided and each of which has a length of λ/4 along a direction (x-axis direction) in which the power feed line (23Li, 23ALi) extends, and the plurality of unit sections have respective widths (W271*ji*, W272*ji*, and W273*ji*) each of which is determined so that characteristic impedances Z1, Zb, and Zc of each adjacent ones of the plurality of unit sections (271*ji*, 272*ji*, and 273*ji*) match each other.

According to the above configuration, it is possible to reduce a return loss that may be caused by connecting the antenna elements to the power feed line. Accordingly, an increase in gain of the antenna device is achieved.

In an aspect of the present invention, the antenna device (1, 1A) is preferably configured such that: the branch section (27*ji*) includes a first section (271*ji*), a second section (272*ji*), and a third section (273*ji*) that are continuously provided from upstream to downstream along the power feed line (23Li, 23ALi); each of the plurality of antenna elements (241*i* through 248*i* and 251*i* through 258*i*, 241Ai through 248Ai and 251Ai through 258Ai) is connected to the vicinity of a boundary between the first section (271*ji*) and the second section (272*ji*); the second section has a width (W272*ji*) with which a branching ratio at the branch section (27*ji*) has a predetermined value; the first section has a width (W271*ji*) with which a combined impedance between the second section (272*ji*) and an antenna element branched from the branch section (27*ji*) matches a characteristic impedance upstream of the branch section; and the third section (273*ji*) has a width (W273*ji*) with which a characteristic impedance of the second section (272*ji*) matches a characteristic impedance downstream of the branch section (27*ji*).

According to this configuration, it is possible to reliably reduce a return loss that may be caused by connecting the antenna elements to the power feed line. Accordingly, an increase in gain of the antenna device is reliably achieved.

In an aspect of the present invention, the antenna device (1, 1A) is preferably configured such that: the number of the plurality of antenna elements (241*i* through 248*i* and 251*i* through 258*i*, 241Ai through 248Ai and 251Ai through 258Ai) is 4 or more; and a/the branching ratio at a/the branch section (27*ji*) at which each of the plurality of antenna elements (241*i* through 248*i* and 251*i* through 258*i*, 241Ai through 248Ai and 251Ai through 258Ai) is connected is lower as the branch section (27*ji*) is provided more upstream along the power feed line (23Li, 23ALi) and is higher as the branch section (27*ji*) is provided more downstream along the power feed line (23Li, 23ALi).

According to this configuration, powers of beams emitted from the respective antenna elements can be easily controlled. This allows a radiant efficiency and a side lobe ratio of the antenna device to be easily controlled. In other words, the designing of the antenna device having a desired radiant efficiency and side lobe ratio is facilitated.

In an aspect of the present invention, the antenna device (1A) is preferably configured such that: the power feed line (23ALi) includes (1) a power feed section (231ALi) including the feed part (23APi) and extending along a first direction (y-axis direction), (2) a first radiation section (232ALi) extending from one end (an end on a y-axis negative direction side) of the power feed section (231ALi) along one (x-axis positive direction) of two directions of a second direction (x-axis direction) that intersects with the first direction (y-axis direction), and (3) a second radiation section (233ALi) extending from the other end (an end on a y-axis positive direction side) of the power feed section (231ALi) along the other (x-axis negative direction) of the two directions of the second direction (x-axis direction); one or more antenna elements (241Ai through 248Ai) connected to the first radiation section (232ALi) and one or more antenna elements (251Ai through 258Ai) connected to the second radiation section (233ALi) are arranged on the same straight line (a straight line extending along the x-axis and passing through the feed part 23APi); an end section (3221Ai) including the end of the any one (322Ai) of the output ports of the Rotman lens (32A), which end is coupled to the feed part (23APi), extends along the first direction (y-axis direction); and a section (3222Ai) of the any one (322Ai) of the output ports which section is continuous with the end section extends along the second direction (x-axis direction).

According to this configuration, since the plurality of antenna elements are provided on the same straight line, it is possible to perform beam scanning over a wide band and at a wide angle. Note that the section continuous with the end section of the any one of the output ports only needs to extend along the second direction, and is not limited to a particular shape. For example, a shape of the section may be a straight line or a serpentine curve.

In an aspect of the present invention, the antenna device (1, 1A) is preferably configured such that the plurality of antenna elements (241*i* through 248*i* and 251*i* through 258*i*, 241Ai through 248Ai and 251Ai through 258Ai) are congruent.

According to this configuration, congruency of the plurality of antenna elements facilitates designing of the antenna device.

The present invention is not limited to the embodiments, but can be altered by a skilled person in the art within the scope of the claims. The present invention also encompasses, in its technical scope, any embodiment derived by combining technical means disclosed in differing embodiments.

REFERENCE SIGNS LIST

1, 1A: Beam forming antenna (antenna device)
11: Ground layer
111: Plurality of slots
111*i*: Slot
21: Dielectric layer
22, 22A: Plurality of antenna arrays
22*i*, 22Ai: Antenna array
23Li, 23ALi: Power feed line
23Pi, 23APi: Feedpoint
231ALi: Power feed section
232ALi: First radiation section
233ALi: Second radiation section
241*i* to 248*i*, 251*i* to 258*i*, 241Ai to 248Ai, 251Ai to 258Ai: Antenna element
261*i* to 268*i*: Sub power feed line
27*ji*: Branch section
271*ji*, 272*ji*, 273*ji*: First to third sections (unit section)
W271*ji*, W272*ji*, W273*ji*: Widths of first to third sections
31: Dielectric layer
32, 32A: Rotman lens
321: Plurality of power feed ports
321*i*: Power feed port
322, 322A: Plurality of output ports
322*i*, 322Ai: Output port
3221Ai: End section
3222Ai: Center section (section continuous with end section)
323: Main body

The invention claimed is:

1. An antenna device comprising:

a ground layer made of an electric conductor;

a plurality of array antennas provided in a layer above the ground layer so as to be spaced apart from the ground layer; and a Rotman lens provided in a layer below the ground layer so as to be spaced apart from the ground layer, each of the plurality of array antennas (i) including: a power feed line at a center of which a feedpoint is located; and a plurality of antenna elements connected to the power feed line and (ii) having a point symmetric shape with respect to the feedpoint as a center of symmetry, the feedpoint of each of the plurality of array antennas being coupled to an end of any one of output ports of the Rotman lens via a slot provided in the ground layer, wherein in a case where an effective wavelength, on the power feed line, of a center frequency of an operation band of the antenna device is defined as a center wavelength λ, a branch section, which is a section at which each of the plurality of antenna elements is connected to the power feed line, is constituted by a plurality of unit sections which are continuously provided and each of which has a length of λ/4 along a direction in which the power feed line extends, and the plurality of unit sections have respective widths each of which is determined so that characteristic impedances of each adjacent ones of the plurality of unit sections match each other.

2. The antenna device as set forth in claim 1, wherein:

the branch section includes a first section, a second section, and a third section that are continuously provided from upstream to downstream along the power feed line;

each of the plurality of antenna elements is connected to the vicinity of a boundary between the first section and the second section;

the second section has a width with which a branching ratio at the branch section has a predetermined value;

the first section has a width with which a combined impedance between the second section and an antenna element branched from the branch section matches a characteristic impedance upstream of the branch section; and the third section has a width with which a characteristic impedance of the second section matches a characteristic impedance downstream of the branch section.

3. The antenna device as set forth in claim 1, wherein:

the number of the plurality of antenna elements is 4 or more; and a branching ratio at a branch section at which each of the plurality of antenna elements is connected is lower as the branch section is provided more upstream along the power feed line and is higher as the branch section is provided more downstream along the power feed line.

4. The antenna device as set forth in claim 1, wherein:

the power feed line includes (1) a power feed section including the feedpoint and extending along a first direction, (2) a first radiation section extending from one end of the power feed section along one of two directions of a second direction that intersects with the first direction, and (3) a second radiation section extending from the other end of the power feed section along the other of the two directions of the second direction;

one or more antenna elements connected to the first radiation section and one or more antenna elements connected to the second radiation section are arranged on the same straight line;

an end section including the end of the any one of the output ports of the Rotman lens, which end is coupled to the feedpoint, extends along the first direction; and a section of the any one of the output ports which section is continuous with the end section extends along the second direction.

5. The antenna device as set forth in claim 1, wherein the plurality of antenna elements are congruent.

* * * * *